United States Patent [19]

Murray

[11] Patent Number: 4,540,353

[45] Date of Patent: Sep. 10, 1985

[54] TWO STAGE VACUUM PUMP WITH SHAFT SEAL

[75] Inventor: Gary P. Murray, Montpelier, Ohio

[73] Assignee: Robinair Division, Montpelier, Ohio

[21] Appl. No.: 578,136

[22] Filed: Feb. 8, 1984

Related U.S. Application Data

[63] Continuation-in-part of Ser. No. 387,620, Jun. 11, 1982, abandoned.

[51] Int. Cl.[3] ..... F04C 2/00; F04C 11/00; F04C 27/02; F04C 29/02

[52] U.S. Cl. ..... 418/13; 418/96; 418/104; 418/142; 418/DIG. 1; 277/188 A

[58] Field of Search ..... 418/13, 96, 104, DIG. 1, 418/142, 97, 133; 277/188 A, 188 R

[56] References Cited

U.S. PATENT DOCUMENTS

| | | | |
|---|---|---|---|
| 1,245,691 | 11/1917 | Deysher | 418/13 |
| 2,450,190 | 9/1948 | Fabian | 418/96 X |
| 2,560,917 | 7/1951 | Bebinger | 277/188 R X |
| 2,588,430 | 3/1952 | Svenson | 103/135 |
| 3,040,973 | 6/1962 | Wessling | 418/13 |
| 3,415,444 | 12/1968 | Frenzel et al. | 418/104 |
| 3,791,780 | 2/1974 | Fritch et al. | 418/60 |
| 3,837,764 | 9/1974 | Fritch et al. | 417/62 |
| 3,838,950 | 10/1974 | Andriulis | 418/97 X |
| 3,982,864 | 9/1976 | Cain | 418/149 |
| 4,120,621 | 10/1978 | Pikul | 418/99 |
| 4,137,018 | 1/1979 | Brucken | 417/440 |
| 4,283,167 | 8/1981 | Bassan et al. | 418/13 |
| 4,295,794 | 10/1981 | Cain | 417/62 |

FOREIGN PATENT DOCUMENTS

| | | | |
|---|---|---|---|
| 2340356 | 2/1975 | Fed. Rep. of Germany | 418/96 |

*Primary Examiner*—John J. Vrablik
*Assistant Examiner*—Theodore Olds
*Attorney, Agent, or Firm*—Beaman & Beaman

[57] ABSTRACT

The invention pertains to a two-stage vacuum pump for servicing refrigeration systems wherein a pair of electrically driven rotors support movable vanes engaging the cylindrical circumference of pumping chambers in which the rotors are mounted. The improvements pertain to the sealing of the rotor shaft, the introduction of metered oil into the pump, and the keying of a rotor to its driveshaft wherein improved assembly and operational characteristics are achieved.

3 Claims, 8 Drawing Figures

TWO STAGE VACUUM PUMP WITH SHAFT SEAL

BACKGROUND OF THE INVENTION

This application is a continuation-in-part of Ser. No. 06/387,620 filed June 11, 1982 now abandoned.

Vacuum pumps are widely used in the servicing of refrigeration circuits as such circuits must be evacuated of air prior to being charged with refrigerant. A variety of commercially available pumps for such purpose are available, such as shown in assignee's U.S. Pat. Nos. 3,791,780; 3,837,764; 3,982,864; 4,295,794 and 4,120,621, and it is known to incorporate multiple pumping stages into such pumps connected in series wherein a high vacuum may be produced. Such pumps use various types of pumping elements, such as pistons, lobes, eccentric rotors, vanes and the like.

In the evacuation of refrigeration circuits, the vacuum pump must handle the lubricant which is used within the circuit to lubricate the compressor, and vacuum pumps usually operate within an oil reservoir for lubrication, sealing and heat dissipation purposes.

An object of the invention is to provide a concise, economical, relatively light weight, rugged, dependable vacuum pump having a long effective wear life and capable of drawing a relatively high vacuum at acceptable pumping capacities particularly suitable for refrigeration servicing purposes.

Another object of the invention is to provide a two stage electrically driven pump employing sealing means interposed between the rotor driveshaft and a rotor to prevent vacuum leakage along the rotor shaft within the pump module.

Another object of the invention is to provide a two stage electrically driven vacuum pump employing an oil baffle at the outlet of the pump module, the baffle incorporating an oil passage associated with a baffle mounting bolt wherein lubricating oil is drawn into the pump module in a metered matter.

Yet another object of the invention is to provide a two stage electrically driven vacuum pump employing a pump module having a pair of rotors wherein the rotors are keyed to a driveshaft, and at least one of the keys is in the form of a radially disposed cylindrical pin having an outer flattened end received within the rotor key slot.

In the practice of the invention a pair of pump rotors of the vane type are encased within a pump module located within the pump casing. An electric motor is drivingly connected to the module driveshaft, and the driveshaft is keyed to first and second rotors which constitute first and second pump stages. The module includes an inlet plate having an inlet port through which refrigerant is drawn, and the stages are interconnected by an intermediate valve plate wherein the second stage exhausts refrigerant through an outlet port into the casing for venting to the atmosphere.

To prevent loss of vacuum from the module through the driveshaft, an O-ring is interposed between the first stage rotor and the driveshaft adjacent the inlet plate, and this seal has proven effective to improve the efficiency of the pump.

Another feature of the invention lies in the metering of the supply of lubricating oil from the pump casing to the module through a slot defined in a baffle plate used to baffle the refrigerant exhausted from the module to separate oil drops from the gas. The oil baffle is affixed to the pump module by a pair of tie bolts maintaining the module assembly and a slot defined in the baffle meters the amount of oil drawn into the pump module through a tie bolt hole. Internally, the module exhaust plate includes a passage intersecting the tie bolt hole through which oil passes wherein the lubricant is drawn into a low pressure region of the second stage rotor. In this manner, effective lubrication of the module is provided without requiring expensive metering apparatus.

A third improvement is directed to the use of a unique key for affixing the first stage rotor to its driveshaft. Due to clearance problems a conventional woodruff key cannot readily be employed with the first stage rotor, and the invention utilizes a cylindrical blind bore defined in the driveshaft which receives a cylindrical pin having a flattened outer end received within the rotor keyway.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
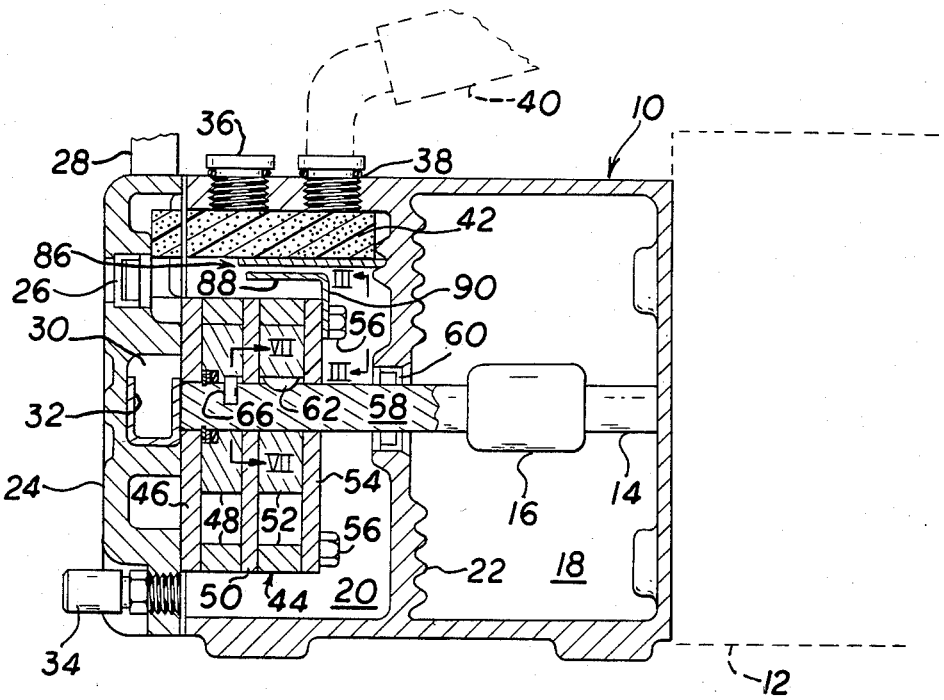
FIG. 1 is an elevational, diametrical, sectional view taken through a pump casing utilizing the inventive concepts.

The basic pump structure in which the instant improvements are utilized is disclosed in Ser. No. 06/387,620 filed June 11, 1982, and in FIG. 1 only the pump casing 10 is illustrated, and for purpose of clarification the electric motor 12 is only schematically represented. The electric motor is attached to the right wall of the casing by threaded fasteners and includes a driveshaft 14 which is connected to the pump module rotor shaft by a coupling 16.

The casing 10 includes a coupling compartment 18, and a pump module compartment 20 separated by integral cast partition 22. The left end of the casing is closed by a removable cover 24 by threaded fasteners, not shown, and the cover includes a sight glass 26 for determining the oil level within the compartment 20 and inlet fitting 28 communicates with the inlet chamber 30 through the filter 32. A drain valve 34 communicates with the lower region of the compartment 20.

Oil is supplied to the compartment 20 through the oil fill plug 36, and refrigerant is exhausted from the chamber through port 38, which, preferably, communicates with the hollow handle 40 whereby the pump may be readily carried. A foam screen 42 aids in the separation of oil from the exhausting refrigerant.

The pump module 44 includes a rectangular inlet plate 46, a first stage rotor and rotor block 48, a central valve plate 50, a second stage rotor and rotor block 52 and an exhaust plate 54. The rotor driveshaft 58 extends through the pump module and is keyed to the first and second stage rotors, and the assembly of the pump module is maintained by four tie bolts 56 extending through holes defined in the plates 46, 50 and 54 and the rotor blocks, and are threaded into the cover 24. The rotor driveshaft 58 is operatively connected to the motor shaft 14 by the coupling 16 and is supported at its outer end by the inlet plate 46, and a seal 60 defined in the driveshaft opening formed in the partition 22 seals the compartment 18 relative to compartment 20.

The first stage rotor 48 and the second stage rotor 52 are each provided with a pair of vanes, not shown, slidably mounted within the rotors having outer ends which engage the cylindrical surface of the associated rotor blocks, and as the driveshaft 58 and rotors are eccentrically related to the rotor block cylinders the vanes extend and retract during each rotor revolution to provide the variable chamber displacement to produce the pumping action in the known manner.

Figure 6:
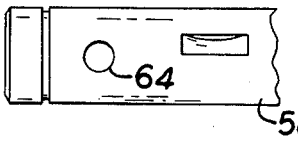
FIG. 6 is an elevational, detail view of the outer end of the rotor driveshaft.
Figure 8:
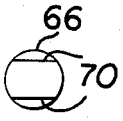
FIG. 8 is a top plan view of the pin key.
Figure 7:
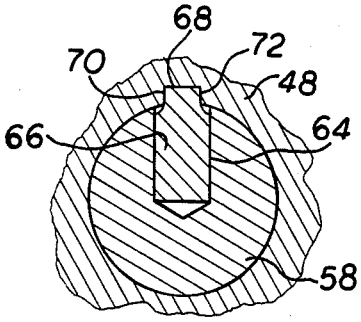
FIG. 7 is an elevational, sectional view of the rotor driveshaft as taken through Section VII—VII of FIG. 1.

The rotors 48 and 52 are keyed to the driveshaft 58, and the second stage rotor 52 uses a conventional woodruff key 62 for this purpose. However, due to limited space, the first stage rotor 48 is keyed to the driveshaft 58 by means of a pin key best illustrated in FIGS. 6–8. A cylinder blind bore 64 is defined in the driveshaft 58 radially oriented to the axis thereof. The bore 64 receives the cylindrical pin 66, and the pin includes an outer end 68 which extends beyond the driveshaft outer diameter. This outer end of the pin 66 is formed with spaced parallel flats 70 which are separated a distance slightly less than the width of the key slot 72, FIG. 7, defined in the first stage rotor, and in this manner the first stage rotor is effectively keyed to the rotor shaft, but little axial dimension of the driveshaft and rotor is required with this key system.

Figure 2:
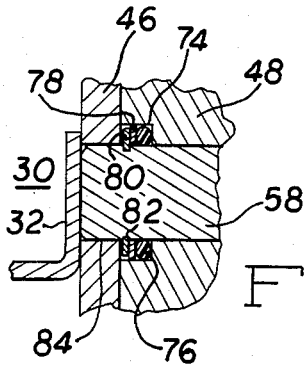
FIG. 2 is an enlarged, detail, elevational, sectional view of the rotor shaft seal.

To prevent vacuum leakage from occurring along the rotor driveshaft 58 intermediate the driveshaft and rotors an O-ring system is employed within the first stage rotor 48. This sealing arrangement includes a cylindrical recess 74 defined in the first stage rotor adjacent the inlet plate 46, FIG. 2, and the recess receives an elastomer O-ring 76 sealingly associated with the recess and the driveshaft. An annular washer 78 is disposed adjacent the O-ring 76, and the seal is maintained upon the driveshaft by means of a snap ring 80 received within an annular groove 82 formed in the driveshaft. As will be appreciated from FIGS. 1 and 2, the left end of the driveshaft is rotatably supported within a bearing bore formed in the inlet plate 46.

The presence of the O-ring 76 prevents vacuum leakage along the driveshaft 58, and the presence of the seal insures a higher efficiency at the inlet chamber 30 than previously attainable with known vacuum pump constructions.

A sheet metal baffle plate 86 is attached to the pump module 44 by the two upper tie bolts 56, and the baffle includes a horizontally disposed portion 88 extending over the pump outlet whereby gas and oil discharge from the pump exhaust port strikes the baffle portion 88 aiding in the separation of oil and gas.

Figure 3:
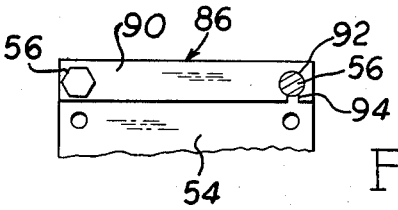
FIG. 3 is an enlarged, detail, elevational view of the baffle plate as taken along Section III—III of FIG. 1, the right bolt head being sectioned.

The baffle 86 also includes a vertical portion 90 which extends along the outside surface of the exhaust plate 54 and includes holes 92 for receiving the tie bolts 56. A slot 94 is defined in the baffle plate portion 90, FIG. 3, intersecting the lower edge of the portion 90, and also intersecting the right hole 92 defined in the portion for receiving the associated tie bolt. The slot 94 functions as a metered restriction permitting oil within the compartment 20 to enter the bolt hole 96 within the exhaust plate 54 receiving the associated tie bolt 56. As the holes 96 within the exhaust plate are slightly larger than the associated tie bolt, oil may readily travel along the tie bolt through the exhaust plate hole 96.

Figure 4:
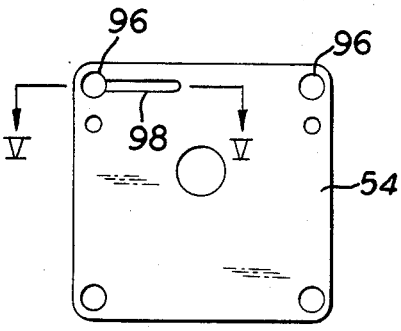
FIG. 4 is an elevational view of the inside surface of the pump module exhaust plate.
Figure 5:
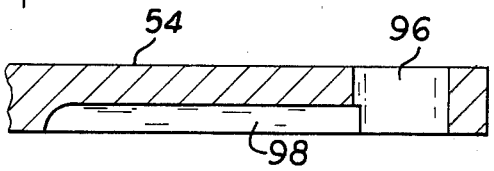
FIG. 5 is a detail, enlarged elevational, sectional view of the exhaust plate passage as taken along Section V—V of FIG. 4.

As will be apparent from FIGS. 4 and 5, the inside surface of the exhaust plate 54 is provided with an elongated passage 98 intersecting the tie bolt hole 96 at one end, and associating with a low pressure portion of the second stage rotor 52 at the other end. Thus, oil entering the baffle plate slot 94 may flow into the pump module at a predetermined rate to aid in the pump module lubrication.

The use of the O-ring 76, the pin key 66, and the oil baffle metering slot 94 all contribute to improvements in the vacuum pump of the invention, and it is appreciated that various modifications to the inventive concepts may be apparent to those skilled in the art without departing from the spirit and scope of the invention.

I claim:

1. A two stage rotary vacuum pump having a casing including a cover including a pump module within the casing attached to the cover having first and second pumping chambers defined therein each having a cylindrical circumference, a rotor shaft rotatably mounted within the module extending through the chambers and eccentrically related thereto, an electric motor drivingly connected to the rotor shaft, first and second rotors each having an axis, lateral sides, and fixed to the shaft located within the first and second chambers, respectively, at least one vane movably mounted in each rotor extending from the periphery thereof having an outer end engaging the associated chamber circumference, a valve plate located intermediate the rotors having a port defined therein establishing communication between the chambers at predetermined rotational positions of the rotors, an exhaust plate disposed adjacent the rotor having an exhaust port defined therein selectively communicating with the second chamber at a predetermined rotational position of the second rotor, the improvement comprising, said pump module including an inlet face plate adjacent the first rotor having parallel sides and adapted to be located adjacent the casing cover, the rotor shaft having a free end rotatably received and supported within said inlet face plate, and a fluid seal circumscribing the rotor shaft within the first rotor and adjacent said inlet face plate sealing the rotor shaft and first rotor comprising a recess defined in the first rotor adjacent said inlet face plate and concentric to the rotor shaft, said fluid seal comprising an O-ring located within said recess, an annular groove circumscribing the rotor shaft adjacent said inlet face plate, and a snap ring received within said groove positioning said fluid seal upon the rotor shaft.

2. In a rotary vacuum pump as in claim 1, tie bolts extending through the pump module maintaining the assembly thereof, said bolts each having a head adjacent the exhaust plate and extending through a hole in the exhaust plate slightly larger than the associated bolt, a baffle plate attached to the exhaust plate by said tie bolts having a shield portion shielding the exhaust port, holes defined in said baffle plate receiving said tie bolts, a slot defined within said baffle plate intersecting one of said baffle plate holes whereby oil may enter the second chamber through said slot, baffle plate hole and exhaust plate bolt hole and an oil passage defined in the exhaust plate within the second chamber intersecting the bolt hole in communication with said baffle plate slot and low pressure portion within said second chamber.

3. A two stage rotary vacuum pump having a casing including a cover including a pump module within the casing attached to the cover having first and second pumping chambers defined therein each having a cylindrical circumference, a rotor shaft rotatably mounted within the module extending through the chambers and eccentrically related thereto, an electric motor drivingly connected to the rotor shaft, first and second rotors each having an axis, lateral sides, a central hole, axial key slots intersecting the hole and keys fixing the rotors to the shaft located within the first and second chambers, respectively, at least one vane movably mounted in each rotor extending from the periphery thereof having an outer end engaging the associated chamber circumference, a valve plate located intermediate the rotors having a port defined therein establishing communication between the chambers at predetermined rotational positions of the rotors, an exhaust plate disposed adjacent the second rotor having an exhaust port defined therein selectively communicating with the second chamber at a predetermined rotational position of the second rotor, the improvement comprising the key for the first rotor comprising a cylindrical blind bore radially defined in the rotor shaft in radial alignment with the first rotor, a cylindrical pin received within said blind bore having an outer free end radially extending beyond the rotor shaft diameter and an axis, flat, parallel, spaced surfaces defined on said pin free end whereby said free end defines a key received within the key slot formed in the first rotor, said pin flat surfaces being equally spaced from the pin axis, said pump module including an inlet face plate adjacent the first rotor having parallel sides and adapter to be located adjacent the casing cover, the rotor shaft having a free end rotatably received and supported within said inlet face plate, and a fluid seal circumscribing the rotor shaft within the first rotor and adjacent said inlet face plate sealing the rotor shaft and first rotor comprising a recess defined in the first rotor adjacent said inlet face plate and concentric to the rotor shaft, said fluid seal comprising an O-ring located within said recess, an annular groove circumscribing the rotor shaft adjacent said inlet face plate, and a snap ring received within said groove positioning said fluid seal upon the rotor shaft.

* * * * *